United States Patent [19]

Tetaka

[11] Patent Number: 4,805,643

[45] Date of Patent: Feb. 21, 1989

[54] APPARATUS FOR ADJUSTING GAPS BETWEEN A PLURALITY OF MEMBERS DISPOSED IN A LINE AND TOBACCO THRESHER ADOPTING THE SAME

[75] Inventor: Kenju Tetaka, Kumamoto, Japan

[73] Assignee: Japan Tobacco Inc., Tokyo, Japan

[21] Appl. No.: 164,858

[22] Filed: Mar. 7, 1988

[30] Foreign Application Priority Data

Mar. 9, 1987 [JP] Japan ..... 62-52046

[51] Int. Cl.[4] ..... A24B 5/10

[52] U.S. Cl. ..... 131/311; 130/27 L; 241/189 R

[58] Field of Search ..... 131/311, 319, 312, 313, 131/317; 130/27 K, 27 L; 241/189 R

[56] References Cited

U.S. PATENT DOCUMENTS

| | | | |
|---|---|---|---|
| 3,074,415 | 1/1963 | Davidson | 131/311 |
| 3,126,014 | 3/1964 | Bonner, Jr. et al. | 131/311 |
| 3,696,817 | 10/1972 | Bonner, Jr. et al. | 131/311 |

*Primary Examiner*—Vincent Miller
*Assistant Examiner*—Robert W. Bahr
*Attorney, Agent, or Firm*—Nixon & Vanderhye

[57] ABSTRACT

A tobacco threshing system of the present invention comprises a housing, a threshing rotor arranged in the housing, and a threshing basket which covers a lower portion of the rotor. The threshing basket includes a plurality of arcuated plates arranged to have threshing gaps therebetween. The tobacco threshing system further comprises an apparatus for adjusting the threshing gaps. The apparatus includes a drive shaft, a plurality of first sliders mounted on the drive shaft, and a plurality of second sliders mounted on the drive shaft to be located between the first sliders. Each of the first sliders has a first right-handed thread portion on one end thereof and a left-handed thread portion on the other end thereof. Each of the second sliders has, on its two ends, second right- and left-handed thread portions to be screwed to the first right- and left-handed thread portions of the adjacent first sliders. The arcuated plates are connected to the first sliders and/or second sliders.

16 Claims, 8 Drawing Sheets

APPARATUS FOR ADJUSTING GAPS BETWEEN A PLURALITY OF MEMBERS DISPOSED IN A LINE AND TOBACCO THRESHER ADOPTING THE SAME

BACKGROUND OF THE INVENTION

1. Field of the Invention

The present invention relates to an apparatus for adjusting gaps between a plurality of members disposed in a line and a tobacco thresher adopting the same.

2. Description of the Related Art

A conventional tobacco thresher of this type comprises a rotor having a plurality of cutting teeth on its outer surface and a threshing basket provided to cover a lower portion of the rotor. The threshing basket have arcuated plates disposed at predetermined gaps in the axial direction of the rotor. Waved blades having a predetermined shape are formed on the two side edges of each arcuated plate. Therefore, threshing gaps having a wave-like shape are arranged in the basket in the axial direction of the rotor.

In the known thresher described above, when tobacco leaves are supplied from above the rotor during rotation of the rotor, the tobacco leaves are guided to the cutting teeth of the rotor and drawn inside the threshing basket. Then, the tobacco leaves are pushed out by the cutting teeth of the rotor and they are discharged from the threshing basket. In this case, the tobacco leaves are subjected to a threshing operation, i.e., a cutting operation by the waved blades of each arcuated plate of the basket and discharged downward from the threshing gaps of the basket. Therefore, as apparent from the above description, the cutting sizes of the respective elements of tobacco leaves, i.e., the leaf blade, the vein, and the petiole are determined in accordance with the threshing gaps of the basket.

When tobacco leaves are to be cut, the size of the threshing gaps of the basket must be adjusted in accordance with the kinds of tobacco leaves. For this purpose, a plurality of baskets having different threshing gaps are prepared for the thresher. When the thresher basket is replaced in accordance with the kinds of tobacco leaves, optimal tobacco threshing can be performed. However, the threshing basket replacement must be manually done and is thus very cumbersome. When the basket is to be replaced, the thresher, i.e., the rotor must be stopped, thus impairing operation efficiency of the thresher.

SUMMARY OF THE INVENTION

The present invention has been made in view of the above situation. It is a primary object of the present invention to provide an apparatus which can easily adjust gaps among members arranged having these gaps therebetween and an apparatus which can automatically perform the gap adjustment. It is a second object of the present invention to provide a thresher adopting the gap adjusting apparatus for adjusting the threshing gaps of a thresher basket, thereby efficiently performing a tobacco leaf threshing operation.

A gap adjusting apparatus for achieving the primary object of the present invention has a reversible drive shaft extending parallel to the array of the members defining gaps. A plurality of first sliders are mounted on the drive shaft. The first sliders are movable along the drive shaft. Each first slider has a first left-handed thread portion on its one end and a first right-handed thread portion on its other end along the axial direction of the drive shaft. Second sliders are mounted on the drive shaft to be located between adjacent first sliders. Each second slider has a second right-handed thread portion on its one end along the axial direction of the drive shaft. Each second right-handed thread portion is integrally movable with the corresponding second slider along the drive shaft. The second right-handed thread portion of each second slider is screwed to the first right-handed thread portion of the first slider adjacent to one end of the second slider. Each second right-handed thread portion is integrally rotatable with the drive shaft. Each second slider has a second left-handed thread portion on its other end to be integrally movable with itself along the drive shaft. The second left-handed thread portion of each second slider is screwed to the first left-handed thread portion of the first slider adjacent to the other end side of the second slider. Each second left-handed thread portion is integrally rotatable with the drive shaft in the same manner as the second right-handed thread portion.

One end of each member defining a gap described above is fixed to the sliders. The other end of each member is guided to move along the axial direction of the drive shaft by a guide means.

In the gap adjusting apparatus described above, assuming that the first slider is fixed and the drive shaft is rotated, two second sliders on right and left sides of the first slider are moved along the drive shaft to move close to or away from the first slider. More specifically, the second right- and left-handed thread portions of each second slider are rotated together with the drive shaft. Therefore, when the drive shaft is rotated in one direction, for example, the second right- and left-handed thread portions are removed from the first slider. The second right- and left-handed thread portions are coupled to the second slider such that they are integrally moved along the drive shaft. As a result, the right and left second sliders are moved along the drive shaft in synchronism with each other to separate from the central first slider. When the drive shaft is rotated in the reverse direction, the right and left second sliders are moved in synchronism with each other in directions to move close to the central first slider.

The first and second sliders are connected to each other through the right- and left-handed thread portions. Therefore, each slider is moved along the drive shaft by rotation of the drive shaft to widen or reduce intervals between the adjacent sliders.

The members fixed to each of the first and second sliders are moved along the axial direction of the drive shaft by the rotation of the drive shaft. In this case, the gaps between the members are widened or reduced.

Rotation of the drive shaft can be easily controlled by, e.g., an electric motor. Therefore, the gaps among the members can be automatically adjusted.

Furthermore, the gap adjusting apparatus according to the present invention has a simple structure wherein the first and second sliders and the right- and left-handed thread portions are utilized, and the weights of the first and second sliders are supported by the drive shaft. Therefore, the first and second sliders do not greatly increase the weight of the movable parts such as the members described above. An increase in load acting on the electric motor can be effectively suppressed.

It is a second object of the present invention to provide a tobacco thresher wherein the gap adjusting apparatus is adopted for threshing gap adjustment of a threshing basket when arcuated plates of the basket of the thresher described above replace the members described above. As a result, since the threshing gaps of the basket can be easily adjusted, the tobacco leaf threshing operation can be efficiently performed.

DETAILED DESCRIPTION OF THE PREFERRED EMBODIMENTS

Figure 1:
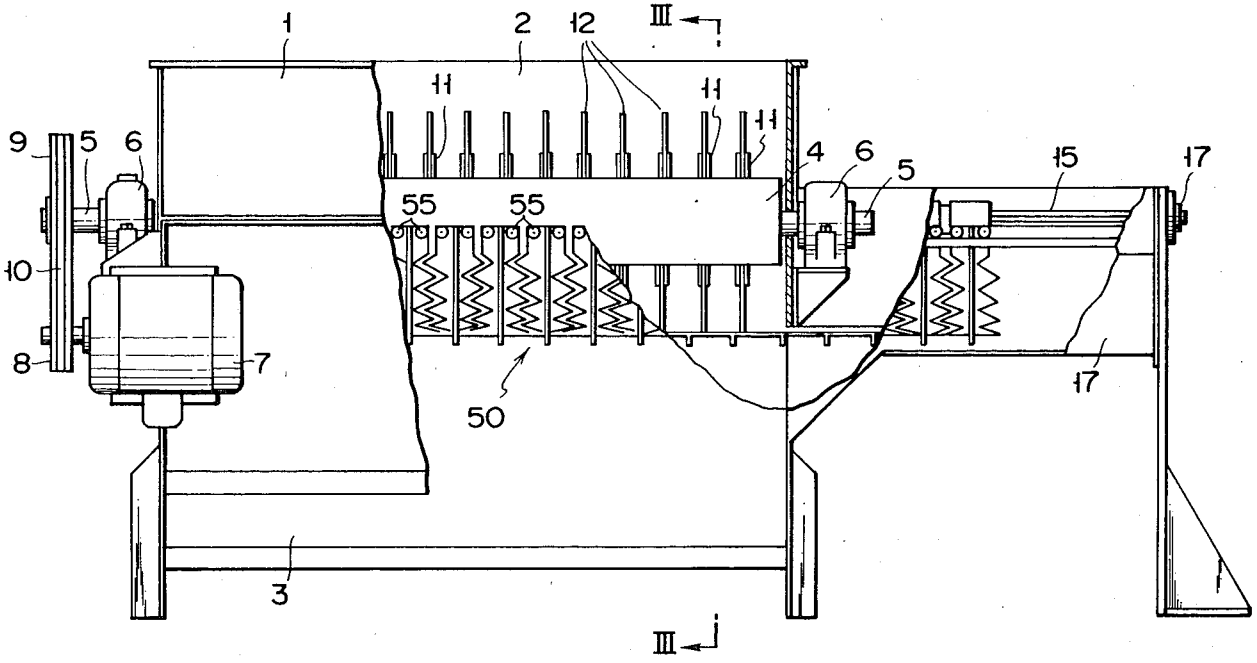
FIG. 1 is a partially cutaway front view of a tobacco thresher.

FIG. 1 shows a tobacco thresher to which an gap adjusting apparatus according to the present invention is applied. The thresher has housing 1. Tobacco leaf charge port 2 is formed in the upper wall of housing 1. Discharge port 3 for discharging the respective elements of a cut tobacco leaf is formed in the lower portion of housing 1.

Rotor 4 is horizontally placed in housing 1. The two ends of rotor 4 form journals 5 protecting from two side surfaces of housing 1. Journals 5 are supported by housing 1 through corresponding bearings 6.

Electric motor 7 is mounted on the front wall of housing 1 to project from one side surface of housing 1. Pulley 8 is mounted on the output shaft of motor 7. Pulley 9 paired with pulley 8 is mounted on the distal end of one journal 5 of rotor 4. Endless drive belt 10 is looped between pulleys 8 and 9. Therefore, when motor 7 is driven in one direction, its drive force is transmitted to rotor 4 through drive belt 10, and rotor 4 is rotated in one direction.

Figure 3:
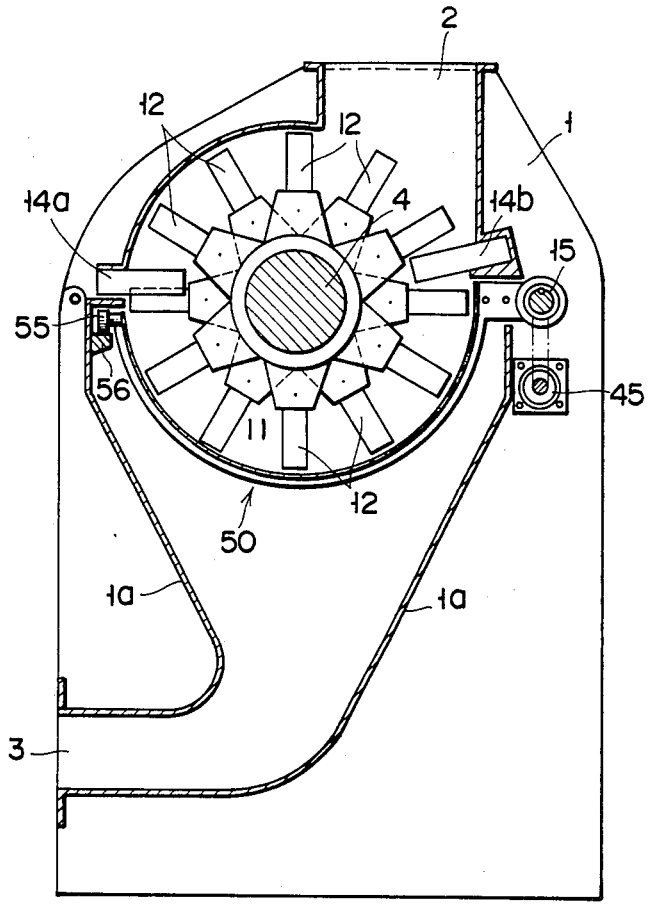
FIG. 3 is a sectional view taken along the line III—III of FIG. 1.

A plurality of support rings 11 are fixed on the outer surface of rotor 4 at constant intervals. A plurality of cutting teeth 12 are mounted on each support ring 11. Cutting teeth 12 project radially and have constant intervals from each other along the circumferential direction of support ring 11. As shown in FIG. 3, cutting teeth 12 of adjacent support rings 11 do not overlap in view of the axial direction of rotor 4.

Stationary teeth **14*a* and 14*b* are fixed inside housing 1 to be level with or slightly higher than the axis of rotor 4, as shown in FIG. 3. Teeth 14*a* and 14*b* sandwich rotor 4 from right and left sides in FIG. 3 and cooperate with cutting teeth 12. Although not shown, stationary teeth 14*a* and 14*b* are arranged at predetermined intervals along the axial direction of rotor 4. The distal end of each of teeth 14*a* and 14*b* projects into the rotating range of cutting teeth 12 as apparent from FIG. 3. In this case, the distal end of each of teeth 14*a* and 14*b* is located between support rings 11 along the axial direction of rotor 4. Therefore, rotation of rotor 4 is not interfered with by teeth 14*a* and 14*b***.

Drive shaft 15 is arranged in housing 1 to be parallel to rotor 4. Drive shaft 15 is located on the rear side of housing 1 in FIG. 1 and level with the axis of rotor 4. One end of drive shaft 15 projects from the side surface of housing 1 on which motor 7 is located, and is rotatably supported by housing 1 through bearings 16 (see FIG. 4). The other end of drive shaft 15 extends from housing 1 into storage box 17 connected to housing 1 and is rotatably supported by box 17 through bearings 18. Housing 1 and storage box 17 communicate with each other.

Figure 4:
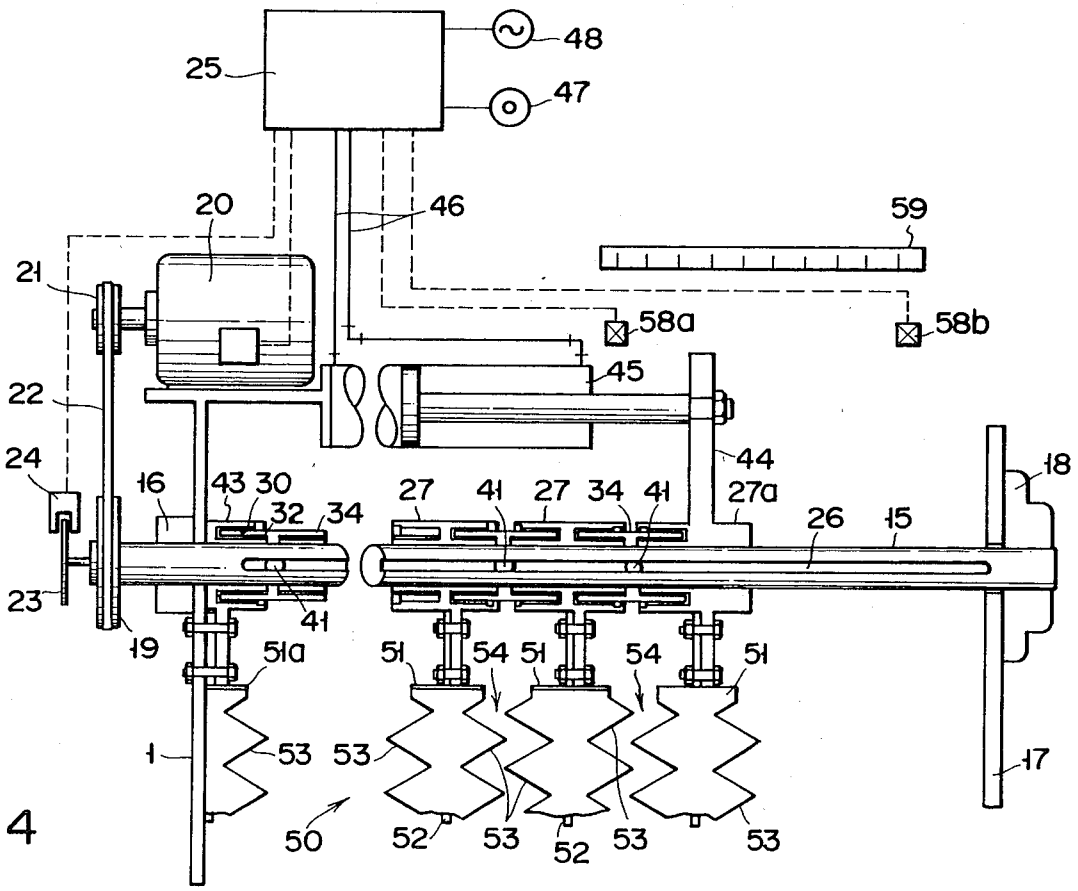
FIG. 4 is a view schematically showing an apparatus for adjusting threshing gaps of the thresher shown in FIG. 1.

Pulley 19 is mounted on one end of drive shaft 15, as shown in FIG. 4. Reversible adjusting motor 20 is provided to housing 1. Motor 20 is fixed in the vicinity of pulley 19. Pulley 21 paired with pulley 19 is mounted on the output shaft of motor 20. Endless drive belt 22 is looped between pulleys 21 and 19. When adjusting motor 20 is driven, its drive force is transmitted to drive shaft 15 through drive belt 22, thereby rotating drive shaft 15.

Toothed disc 23 is mounted on one end of drive shaft 15. Sensor 24 comprising an induction transducer is arranged to straddle toothed disc 23. When drive shaft 15 is rotated, sensor 24 detects teeth of disc 23 passing it, and sends a detection signal to control circuit 25. Control circuit 25 includes a detection cicuit for calculating a rotating angle of toothed disc 23, i.e., drive shaft 15 on the basis of the detection signal supplied from sensor 24. Control circuit 25 is connected to power source 48.

Figure 5:
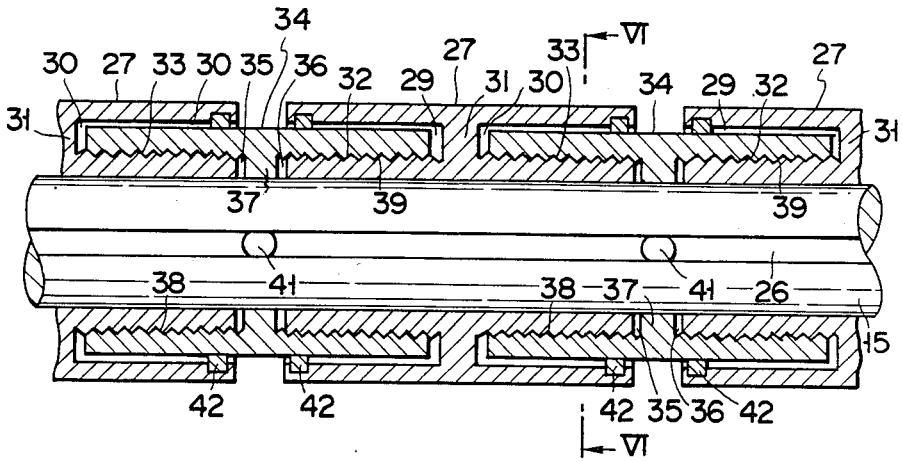
FIG. 5 is a sectional view showing a relationship between the drive shaft and first and second sliders of the adjusting apparatus shown in FIG. 4.
Figure 6:
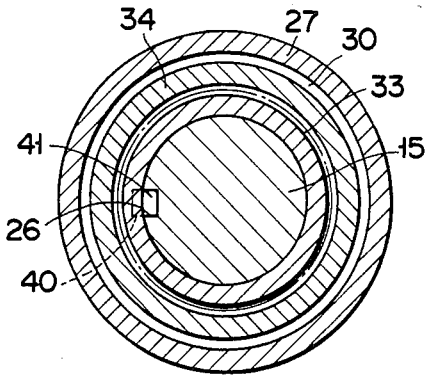
FIG. 6 is a sectional view taken along the line VI—VI of FIG. 5.

Single key groove 26 extending in the axial direction is formed in the outer surface of drive shaft 15. First sliders 27 are mounted on drive shaft 15 at predetermined intervals along the axial direction of drive shaft 15. First sliders 27 are slidable on drive shaft 15 along the axial direction. Each first slider 27 comprises a tubular member in which drive shaft 15 can be inserted, as shown in FIGS. 5 and 6 in detail. Annular holes 29 and 30 having the same size are formed in the two end faces of each first slider 27. Holes 29 and 30 are formed for a predetermined depth along the axial direction of first slider 27. Therefore, holes 29 and 30 are divided by partitioning wall 31. Left-handed, male thread portion 32 (as a first left-handed thread portion) is formed on the inner surface of annular hole 29 closer to one end of drive shaft 15. Right-handed, male thread portion 33 (as a first right-handed thread portion) is formed on the inner surface of hole 30.

Second sliders 34 are mounted on drive shaft 15 to be located between first sliders 27. Second sliders 34 are also slidable on drive shaft 15 along the axial direction in the same manner as first sliders 27. Each second slider 34 comprises a tubular member in which drive shaft 15 can be inserted in the same manner as first sliders 27. More specifically, holes 35 and 36 having the same size are formed in the two end faces of each second slider 34 and extend in the axial direction of second slider 34. Holes 35 and 36 are divided by partitioning wall 37. Right-handed, female thread portion 38 (as a second right-handed thread portion) is formed on the inner surface of hole 35 closer to one end of drive shaft 15.

Left-handed, female thread portion 39 (as a second left-handed thread portion) is formed on the inner surface of hole 36. Right- and left-handed, female thread portions 38 and 39 of each second slider 34 are screwed with right- and left-handed, male thread portions 33 and 32 of two first sliders 27 adjacent to second slider 34, as apparent from FIG. 5. In other words, two annular end portions of each second slider 34 are screwed into annular holes of adjacent first sliders 27.

Through hole for receiving drive shaft 15 is formed in partitioning wall 37 of each second slider 34. Key groove 40 is formed in the inner surface of through hole as shown in FIG. 6. Slidable keys 41 are fitted with both key groove 40 and key groove 26 of drive shaft 15 described above. Slidable keys 41 are fixed within key grooves 40 of second sliders 34 and slidable in key groove 26 in drive shaft 15. Therefore, when drive shaft 15 is rotated in the manner as described above, each of second sliders 34 is rotated together with it. However, second sliders 34 are movable along key groove 26 in drive shaft 15.

Seals 42 are provided in the two ends of each first slider 27 to be in slidable contact with the inner surfaces of second sliders 34. Seals 42 prevent dust from entering the screwed surfaces of first and second sliders 27 and 34.

Referring again to FIG. 4, stationary socket 43 is mounted on a portion of drive shaft 15 on its one end side to be located within housing 1. Since stationary socket 43 has a similar structure to the right half of first slider 27 shown in FIG. 5, it has annular hole 30 and right-handed, male thread portion 33. As a result, left-handed, female thread portion 39 of second slider 34 is screwed to thread portion 33 of socket 43.

Annular hole 30 and right-handed, male thread portion 33 need not be formed in first slider **27*a* closest to the other end of drive shaft 15, but can be omitted as shown in FIG. 4**.

Figure 2:
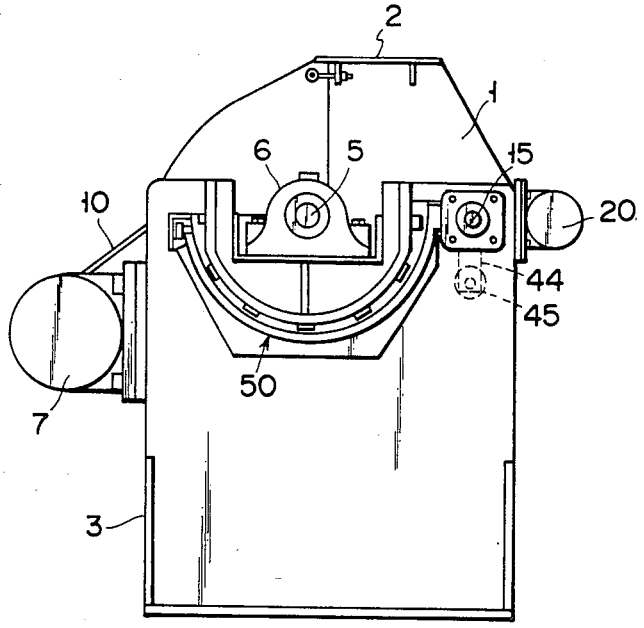
FIG. 2 is a side view of the thresher.

Bracket 44 is formed on first slider **27*a* and extends downward from it. In FIG. 4, bracket 44 extends horizontally from first slider 27*a* for the sake of convenience of drawing. Pneumatic cylinder 45 is arranged below drive shaft 15, as shown in FIGS. 2 and 3. Cylinder 45 is schematically shown in FIG. 4. Cylinder 45 extends parallel to drive shaft 15 and its outer cylinder tube is supported by housing 1. The distal end of the piston rod of cylinder 45 is coupled to bracket 44. Cylinder 45 is connected to a solenoid controlled directional valve (not shown) included in control circuit 25 through two pneumatic pipes 46. The directional control valve is connected to pneumatic source 47**.

Threshing basket 50 is arranged below rotor 4 to cover the lower portion of rotor 4 and extend into storage box 17, as shown in FIGS. 1 and 3. Basket 50 comprises a plurality of arcuated plates 51 arranged to have threshing gaps in the axial direction of drive shaft 15 and arcuated to cover the lower portion of rotor 4. Reinforcing rib 52 is provided on the outer periphery of each arcuated plate 51. Two sides of each arcuated plate 51 form wave-like blades 53, respectively. A pair of opposing blades 53 of adjacent plates 51 have shapes to mesh with each other, as apparent from FIG. 4. Therefore, threshing gap 54 having a wave-like form determined by the shape of blades 53 is defined between adjacent plates 51. Each gap 54 has a uniform size throughout the entire peripheries of corresponding plates 51. Guide walls la extending from basket 50 to discharge port 3 are provided in housing 1, as shown in FIG. 3.

One end of each arcuated plate 51 is connected to stationary socket 43 or first slider 27 or **27*a* described above through a bolt and a nut. More specifically, a coupling arm is formed on each of first slider 27 or 27*a* and stationary socket 43 and is connected to reinforcing rib 52 of corresponding arcuated plate 51. As shown in FIG. 4, arcuated plate 51*a* coupled to socket 43 has only one blade 53 projecting into housing 1. These plate 51*a* and socket 43 are fixed on housing 1** through bolts and nuts.

Roller 55 is rotatably mounted on the other end of each arcuated plate 51, as shown in detail in FIG. 3. Roller 55 is movable on guide rail 56 attached inside housing 1 along the axial direction of drive shaft 15. Guide rail 56 is parallel to drive shaft 15, and roller 55 and guide rail 56 constitute a guide means for each plate 51. As is understood from the above description, first sliders 27 are prevented from being rotated.

A pair of proximity switches **58*a* and 58*b* are arranged in housing 1 to be separated from each other in the axial direction of drive shaft 15, as shown in FIG. 4. Switches 58*a* and 58*b* are turned on when bracket 44 of first slider 27*a* is moved close to them. Detection signals from switches 58*a* and 58*b* are supplied to control circuit 25 described above. Scale plate 59 is arranged in the vicinity of bracket 44 and extends along the axial direction of drive shaft 15. With scale board 59, the length of basket 50 in the axial direction from a position pointed by the distal end of bracket 44** can be visually confirmed.

The operation of the thresher described above will be described.

Rotor 4 is rotated in the direction indicated by an arrow in FIG. 4. In this case, pneumatic cylinder 45 is pressurized in a direction to contract its piston rod. In this state, when tobacco leaves are supplied through charge port 2 of housing 1, they are urged into basket 50 along with the rotation of rotor 4, i.e., cutting teeth 12, and are moved along the inner surface of basket 50. In this case, the tobacco leaves are cut since rotating cutting teeth 51 cooperate with blades 53 of arcuated plates 51 constituting basket 50. Thus, the tobacco leaves are cut into leaf blades, veins, and petioles having predetermined sizes and are discharged from basket 50 through threshing gaps 54 of basket 50. Therefore, the sizes of the respective elements of tobacco leaves such as leaf blades, veins, and petioles are determined by the size of threshing gaps 54. The respective tobacco leaf elements that are cut are guided from basket 50 to discharge port 3 as they are guided along guide walls la of housing 1 and are conveyed to a following step from discharge port 3.

Figure 7:
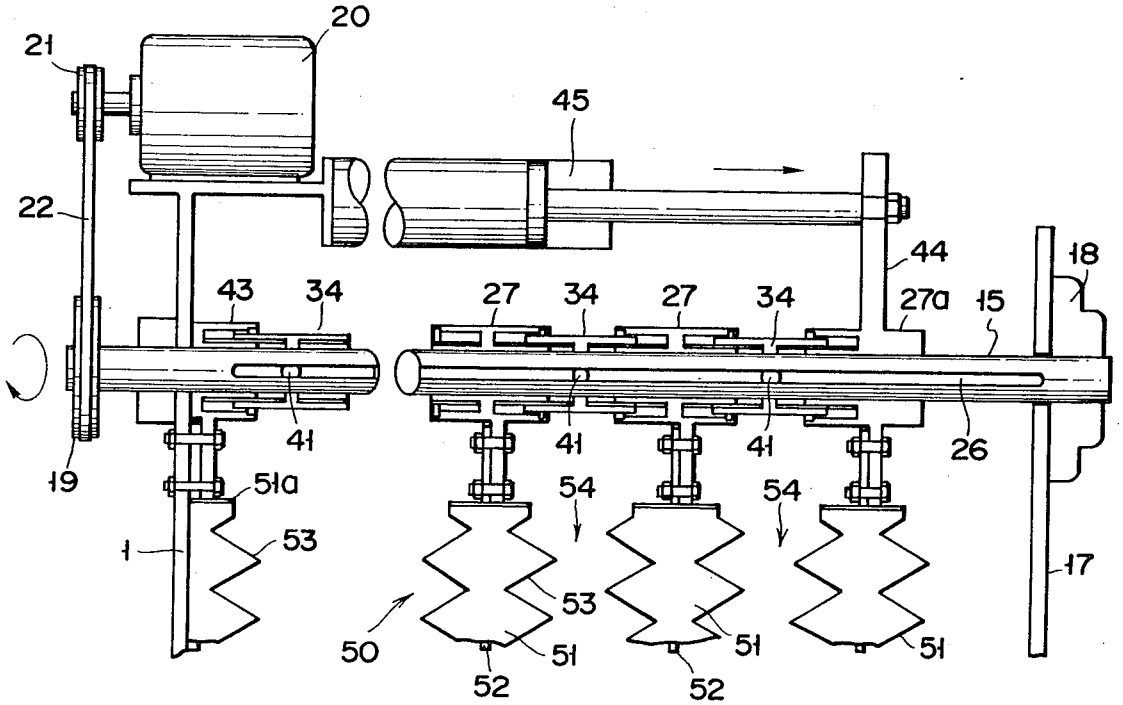
FIG. 7 is a view schematically showing the operating state of the adjusting apparatus shown in FIG. 4.

Subsequently, a sequence for adjusting the size of threshing gaps 54 of basket 50 in accordance with the kinds of the tobacco leaves will be described. First, a sequence for widening threshing gaps 54 from the state shown in FIG. 4 to the state shown in FIG. 7 will be described. Originally, pneumatic cylinder 45 is pressurized in the direction to contract its piston rod. Therefore, cylinder 45 is pressurized in a direction to extend its piston rod. Then, adjusting motor 20 is driven to rotate drive shaft 15 clockwise through a predetermined angle in view from one end of drive shaft 15. The rotating angle of drive shaft 15 is detected by toothed disc 23 and sensor 24 described above. Therefore, when drive shaft 15 is rotated through a predetermined rotating angle, rotation of adjusting motor 20 is stopped.

When drive shaft 15 is rotated in the manner as described above, second sliders 34 are also rotated since they are coupled to drive shaft 15 through keys 41. Second slider 34 screwed to stationary socket 43 is coupled to both stationary socket 43 and first slider 27 through screw couplings of different screw directions. Thus, when this second slider 34 is rotated clockwise, it is moved on drive shaft 15 to the right in FIG. 4 to be removed from both stationary socket 43 and first slider 27. Then, adjacent first slider 27 is driven by a reaction force from second slider 34 and is moved on drive shaft 15 to the right similarly to second slider 34.

All the first and second sliders 27, . . . , 27*a* and 34 mounted on drive shaft 15 move in the same manner as these first and second sliders 27 and 34. Therefore, the intervals of first sliders 27 are widened in accordance with the rotating angle of drive shaft 15. Thus, the gaps of arcuated plates 51 of basket 50 that are coupled to corresponding first sliders, i.e., cutting gaps 54 are also widened in the axial direction of drive shaft 15. In this case, since pneumatic cylinder 45 is pressurized in the direction to extend its piston rod, each slider can be moved smoothly by the extending operation of cylinder 45.

When pneumatic cylinder 45 is pressurized in a direction to contract its piston rod and then drive shaft 15 is rotated in the reverse direction, unlike the above-described case, threshing gaps 54 of basket 50 are reduced in the axial direction of drive shaft 15 as is already apparent from the above description.

Since the thresher according to the present invention has basket 50 with adjustable threshing gaps 54, when cutting is to be performed, the size of threshing gaps 54 can be easily set in accordance with the kinds of tobacco leaves without a need to exchange the entire basket. As a result, the cutting operation can be performed efficiently.

In addition, since threshing gaps 54 of basket 50 are adjusted by the first and second sliders that are guided to move along drive shaft 15, the adjusting mechanism can be easily fabricated.

Since threshing gaps 54 are adjusted by rotating drive shaft 15, as described above, adjustment can be done even during operation of the thresher, i.e., rotation of rotor 4.

According to the embodiment described above, proximity switches 58*a* and 58 are provided for detecting a position of bracket 44 of basket 50. Therefore, the minimum and maximum axial lengths of basket 50, i.e., the minimum and maximum sizes of threshing gaps 54 can be set by utilizing switches 58*a* and 58*b*. Moreover, because of the presence of scale plate 59, the size of threshing gaps 54 can be visually confirmed.

When adjustment of threshing gaps 54 of basket 50 is not performed, pneumatic cylinder 45 is pressurized in a direction to contract its piston rod. Therefore, screw coupling between the first and second sliders can be firmly maintained, and this screw coupling can be protected.

Figure 8:
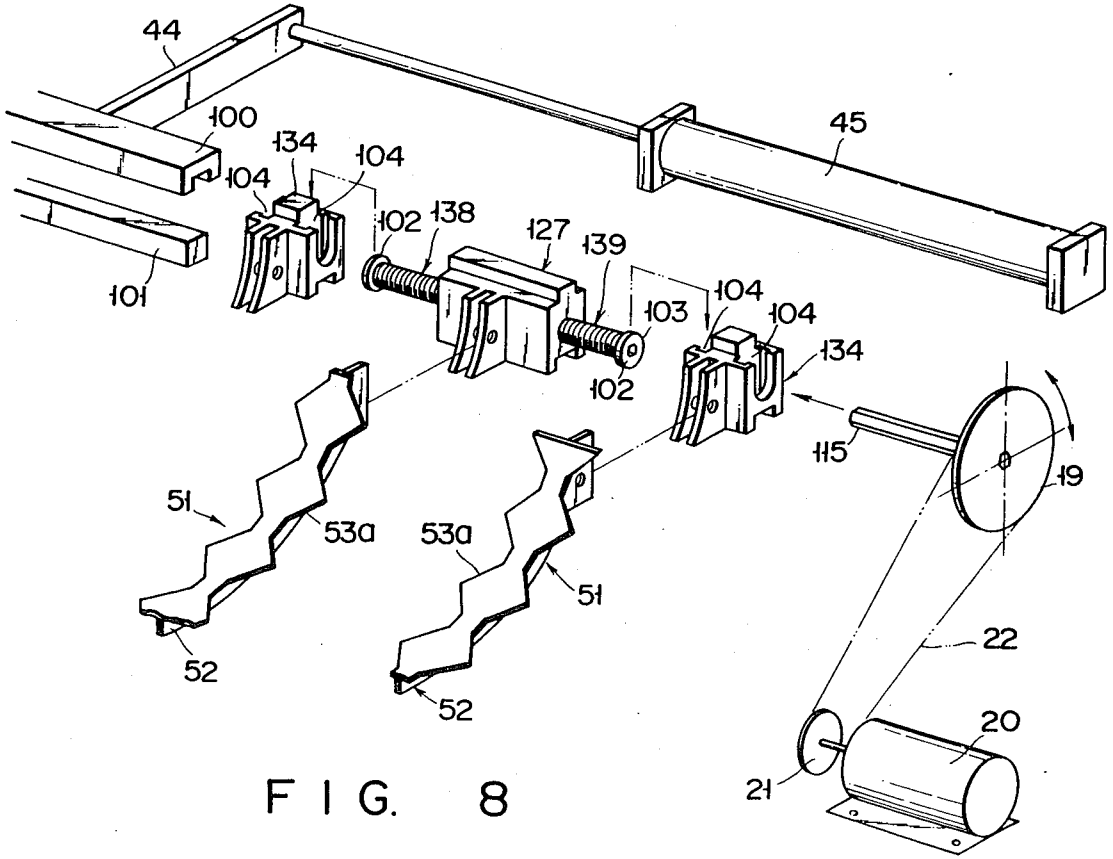
FIG. 8 is an exploded perspective view of another apparatus for adjusting threshing gaps of a threshing basket.
Figure 9:
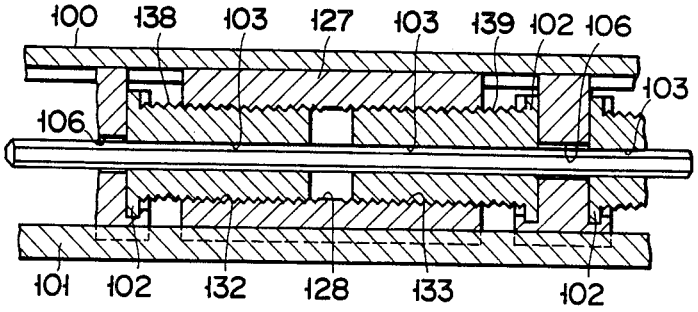
FIG. 9 is a sectional view showing a relationship between the drive shaft and the first and second sliders of the adjusting apparatus shown in FIG. 8.

Basket 50 in a second embodiment of the present invention will be described with reference to FIGS. 8 and 9. In the second embodiment, first and second sliders 127 and 134 are used in place of first and second sliders 27 and 34 of the first embodiment. First and second sliders 127 and 134 are guided by upper and lower guide rails 100 and 101 to move along the axial direction of rotor 4, as shown in FIGS. 8 and 9. Through hole 128 is formed in first slider 127, as shown in FIG. 9. Right- and left-handed, female thread portions 132 and 133 (as first right- and left-handed thread portions) are separately formed on the two end portions of through hole 128, respectively. Right-handed, male thread portion 138 (as a second right-handed thread portion) is screwed into thread portion 132 of each first slider 127, and left-handed, male thread portion 139 (as a second left-handed thread portion) is screwed into thread portion 133 of each first slider 127. Flanges 102 are formed on the outer ends of thread portions 138 and 139. Hexagonal holes 103 are formed extending in thread portions 138 and 139, respectively.

Engaging dents 104 capable of fitting with flanges 102 of right- and second-handed, male thread portions 138 and 139 are formed on the two ends of each second slider 134. When flange 102 of a male thread portion is fitted in dent 104, second slider 134 and right- and left-handed, male thread portions 138 and 139 are integrally moved while right- and left-handed, male thread portions 138 and 139 are able to rotate with respect to second slider 134. Through hole 106 is formed in second slider 134. Through hole 106 has a larger diameter than that of hexagonal hole 103 of each of right- and left-handed, male thread portions 138 and 139 and coaxial with hexagonal hole 103.

Drive shaft 15 of the first embodiment is replaced by drive shaft 115 having a hexagonal section in the second embodiment. Drive shaft 115 extends in through hole 106 of second slider 134, hexagonal holes 103 of right- and left-handed, male thread portions 138 and 139, and first slider 127.

According to the second embodiment described above, when drive shaft 115 is rotated in one direction, both right- and left-handed, male thread portions 138 and 139 screwed to first slider 127 are rotated together with drive shaft 115 and thus are moved on drive shaft 115 to be removed from first slider 127. As a result, two second sliders 134 on both sides of given first slider 127 are moved on drive shaft 115 to be separated from first slider 127. On the contrary, when drive shaft 115 is rotated in the reverse direction, two second sliders 134 are moved on drive shaft 115 to move close to first slider 127. Actually, first slider 127 is also moved along the axial direction of drive shaft 115 since it is driven by the reaction force from second slider 134. Therefore, the intervals between first and second sliders 127 and 134 is widened or reduced in accordance with the forward/reverse rotation of drive shaft 115.

When one end of each of arcuated plates 51 constituting basket 50 is coupled to first or second slider 127 or 134, as shown in FIG. 8, basket 50 having adjustable threshing gaps 54 can be obtained in a similar manner to the first embodiment. In the second embodiment, each blade 53*a* of each arcuated plate 51 of basket 50 has a slightly different shape from that of blade 53 of the first embodiment, and a predetermined distance is provided between adjacent tooth crests of blade 53*a*. In fine, in practicing the present invention, the shape of the blade of arcuated plate 51 can be modified in various manners.

Figure 10:
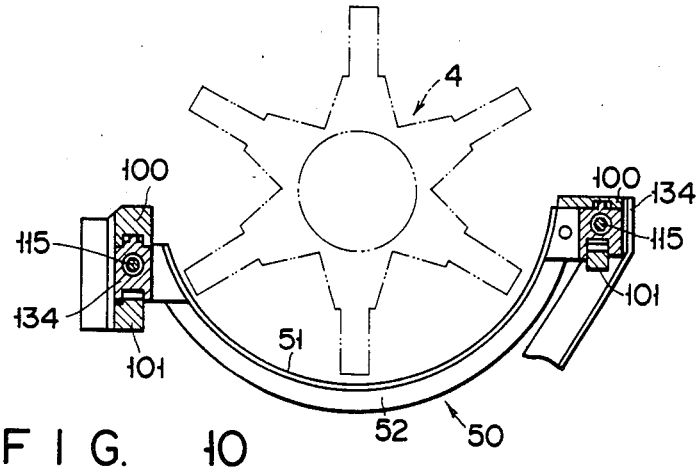
FIG. 10 is a sectional view of another threshing basket.
Figure 11:
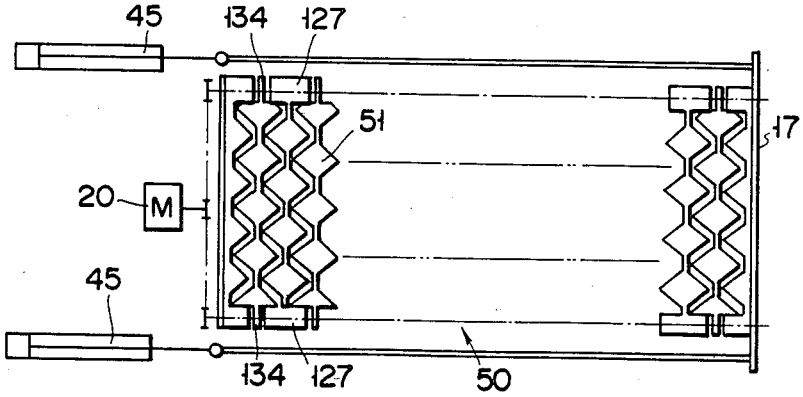
FIG. 11 is a plan view of a threshing basket.

FIGS. 10 and 11 show a third embodiment of the present invention. In the third embodiment, adjusting apparatuses for adjusting threshing gaps 54, as shown in FIGS. 8 and 9, are arranged at two ends of each arcuated plate 51 of basket 50. It is apparent that, with this arrangement, adjustment of threshing gaps 54 of basket 50 can be performed in a similar manner to in the first and second embodiments.

In the third embodiment, only a single adjusting motor 20 is used, as shown in FIG. 11. A pair of drive shafts 115 arranged on two sides of basket 50 are rotated by adjusting motor 20 in synchronism with each other. A pair of pneumatic cylinders 45 are provided to aid the movement of each arcuated plate 51 of basket 50, as shown in FIG. 11.

What is claimed is:

1. An apparatus for adjusting the gaps of a plurality of members which are arranged in a line and spaced apart from one another, and each of which has two ends, said apparatus comprising:

a drive shaft arranged in the vicinity of one end side of said members and extending parallel to the array of said members;

drive means for rotating said drive shaft in forward-/reverse directions;

a plurality of first sliders arranged at predetermined intervals, each of said first sliders being movable along said drive shaft and coupled to the first each of the corresponding one of said members so that rotation thereof is prohibited, and having a first right-handed thread portion on one end thereof and a first left-handed thread portion on the other end thereof;

a plurality of second sliders located between said first sliders, each of said second sliders having, on its two ends, second right- and left-handed, thread portions which are screwed to said first right- and left-handed thread portions on the ends of said adjacent first sliders;

coupling means for guiding each of said second sliders in the axial direction of said drive shaft and for rotating at least said second right- and left-handed thread portions together with said drive shaft; and guide means for guiding the second ends of said members in the axial direction of said drive shaft.

2. An apparatus according to claim 1, wherein said first right- and left-handed thread portions respectively comprise male thread portions, while said second right- and left-handed thread portions respectively comprise female thread portions.

3. An apparatus according to claim 2, wherein: each of said first sliders includes a cylindrical member having a through hole for receiving said drive shaft, a pair of annular holes are formed in two end faces of said cylindrical member, said pair of annular holes being coaxial with said through hole and extending in the axial direction of said through hole, a first right-handed, male thread portion is formed on an inner surface of one of said annular holes, and a first left-handed, male thread portion is formed on an inner surface of the other one of said annular holes; and each of said second sliders includes a tubular member having two end portions capable of being inserted in said annular holes and a partitioning wall at a central portion thereof in the axial direction, a through hole is formed in said partitioning wall of said tubular member to receive said drive shaft therethrough, a second right-handed, female thread portion is formed on an inner surface in one end portion of said tubular member, and a second left-handed, female thread portion is formed on an inner surface in the other end portion of said tubular member.

4. An apparatus according to claim 3, wherein said coupling means includes at least one groove formed in an outer surface of said drive shaft in the axial direction thereof, and a slidable key portion, provided on an inner surface of said through hole of said second slider, and slidable in said groove along the axial direction.

5. An apparatus according to claim 3, wherein seals are mounted on the outer surfaces of said annular holes of said first slider so as to be in slidable contact with an outer surface of said second slider.

6. An apparatus according to claim 1, wherein said first right- and left-handed thread portions respectively comprise female thread portions, while said second right- and left-handed thread portions respectively comprise female thread portions.

7. An apparatus according to claim 6, wherein:

each of said first sliders includes a first body having a through hole for receiving said drive shaft, a first right-handed, female thread portion is formed on an inner surface in one end portion of said through hole, and a first left-handed, female thread portion is formed on the inner surface in the other end portion of said through hole;

each of said second sliders includes a second body having a through hole for receiving said drive shaft with a play, and a pair of shaft portions, arranged on two sides of said second body, having through holes for receiving said drive shaft, being movable together with said second body in the axial direction of said drive shaft, and rotatable with said drive shaft, independent of said second body; and a second right-handed, male thread portion is formed on an outer surface of one of said shaft portions, and a second left-handed, male thread portion is formed on an outer surface of the other one of said shaft portions.

8. An apparatus according to claim 7, wherein said coupling means includes rail means for guiding each said second body in the axial direction of said drive shaft, said drive shaft has a polygonal section, and each of said through holes in said shaft portions has a shape which corresponds to the shape of said drive shaft.

9. A tobacco threshing system comprising: a housing having a supply port on an upper portion thereof which receives tobacco leaves therethrough;

a rotor horizontally arranged in said housing and having a plurality of teeth on a peripheral surface thereof which project in a radial direction;

a threshing basket, arranged in said housing to cover a lower portion of said rotor, said threshing basket including a plurality of arcuated plates arranged in the axial direction of said rotor to have threshing gaps therebetween, each of said arcuated plates being provided with blades on two sides thereof and having two ends; and an apparatus for adjusting the threshing gaps, said apparatus including a drive shaft, arranged in the vicinity of one end side of said arcuated plates and extending parallel to the array of said arcuated plates, drive means for rotating said drive shaft in forward-/reverse directions, a plurality of first sliders arranged at predetermined intervals, each of said first sliders being movable along said drive shaft and coupled to the first end of the corresponding one of said arcuated plates so that rotation thereof is prohibited, and having a first right-handed thread portion on one end thereof and a first left-handed thread portion on the other end thereof, a plurality of second sliders located between said first sliders, each of said second sliders having, on its two ends, second right- and left-handed thread portions to be screwed to said first right- and left-handed thread portions on the ends of said adjacent first sliders, coupling means for guiding each of said second sliders in the axial direction of said drive shaft and for rotating at least said second right- and left-handed thread portions together with said drive shaft; and guide means for guiding the second ends of said members in the axial direction of said drive shaft.

10. A tobacco threshing system according to claim 9, wherein said first right- and left-handed thread portions respectively comprise the male thread portions, while said second right- and left-handed thread portions respectively comprise female thread portions.

11. A tobacco threshing system according to claim 10, wherein:

each of said first sliders includes a cylindrical member having a through hole for receiving said drive shaft therein, a pair of annular holes are formed in the two end faces of said cylindrical member, said pair of annular holes being coaxial with said through hole and extending in the axial direction of said through hole, a first right-handed, male thread portion is formed on an inner surface of one of said annular holes, and a first left-handed, male thread portion is formed on an inner surface of the other one of said annular holes; and each of said second sliders includes a tubular member having two end portions which are capable of being inserted in said annular holes and a partitioning wall at a central portion thereof in the axial direction, a through hole is formed in said partitioning wall of said tubular member to receive said drive shaft therethrough, a second right-handed, female thread portion is formed on an inner surface in one end portion of said tubular member, and a second left-handed, female thread portion is formed on an inner surface in the other end portion of said tubular member.

12. A tobacco threshing system according to claim 11, wherein said coupling means includes at least one groove formed in an outer surface of said drive shaft in the axial direction thereof, and a slidable key portion, provided on an inner surface of said through hole of said second slider, and slidable in said groove along the axial direction.

13. A tobacco threshing system according to claim 11, wherein seals are mounted on the outer surfaces of said annular holes of said first slider to be in slidable contact with an outer surface of said second slider.

14. A tobacco threshing system according to claim 9, wherein said first right- and left-handed thread portions respectively comprise female thread portions, while said second right- and left-handed thread portions respectively comprise female thread portions.

15. A tobacco threshing system according to claim 14, wherein:

each of said first sliders includes a first body having a through hole for receiving said drive shaft therein, a first right-handed, female thread portion is formed on an inner surface in one end portion of said through hole, and a first left-handed, female thread portion is formed on the inner surface in the other end portion of said through hole;

each of said second sliders includes a second body which has a through hole for receiving said drive shaft with a play, and a pair of shaft portions, arranged on two sides of said second body, having through holes for receiving said drive shaft, said shaft portions being movable together with said second body in the axial direction of said drive shaft, and rotatable with said drive shaft, independent of said second body; and a second right-handed, male thread portion is formed on an outer surface of one of said shaft portions, and a second left-handed, male thread portion is formed on an outer surface of the other one of said shaft portions.

16. A tobacco threshing system according to claim 15, wherein said coupling means includes rail means for guiding each of said second bodies in the axial direction of said drive shaft, said drive shaft has a polygonal section, and each of said through holes in said shaft portions has a shape which corresponds to the shape of said drive shaft.

* * * * *